United States Patent [19]

Grewe et al.

[11] 4,145,257

[45] Mar. 20, 1979

[54] DISCHARGE APPARATUS FOR INCLINED COKE OVENS

[75] Inventors: Heinz-Günther Grewe, Höxter; Horst Seeberg, Essen; Horst Fach, Essen; Friedrich Isermann, Essen, all of Fed. Rep. of Germany

[73] Assignee: Didier Engineering GmbH, Essen, Fed. Rep. of Germany

[21] Appl. No.: 818,928

[22] Filed: Jul. 25, 1977

[30] Foreign Application Priority Data

Jul. 24, 1976 [DE] Fed. Rep. of Germany ..... 2633331

[51] Int. Cl.[2] ..... C10B 33/00; C10B 33/08; C10B 43/04

[52] U.S. Cl. ..... 202/241; 13/33; 110/165 R; 202/262; 414/210; 414/214

[58] Field of Search ..... 202/116, 128–130, 202/132, 241, 262; 214/23, 34; 13/33; 110/165 R; 266/19 S

[56] References Cited

U.S. PATENT DOCUMENTS

| | | | |
|---|---|---|---|
| 475,540 | 5/1892 | Coze | 214/23 |
| 669,377 | 3/1901 | Bacon | 214/23 |
| 869,305 | 10/1907 | Hogg | 214/23 |
| 1,211,805 | 1/1917 | Wright | 202/241 |
| 1,362,336 | 12/1920 | Maxwell | 214/23 |
| 1,378,782 | 5/1921 | Griffin | 214/23 |
| 1,438,725 | 12/1922 | Russell | 214/23 |
| 4,067,462 | 1/1978 | Thompson | 214/23 |

*Primary Examiner*—Morris O. Wolk

*Assistant Examiner*—Bradley Garris

*Attorney, Agent, or Firm*—Wenderoth, Lind & Ponack

[57] ABSTRACT

A device for automatically detaching and/or loosening coke within a coke oven chamber, particularly such a chamber of the type having an inclined or obliquely extending floor, includes a track support adapted to be mounted at a position confronting the coke removal opening of the coke oven chamber. An elongated poking bar is supported by the track support and has at a first end thereof a stoking or broaching head for abutting or scraping coke within the chamber. A trolley is mounted on the track support for movement therealong, and the poking bar is pivoted to the trolley. A reversibly operable cable drive moves the trolley and thus the poking bar along the track support from an initial position whereat the poking bar is positioned outside of the chamber to an operative position wherein the broaching head of the poking bar is inserted into the chamber to abut against coke therein. The poking bar is guided during the movement thereof to follow a predetermined displacement path such that the poking bar will avoid obstructions such as a quencher car located outside the coke oven chamber, such that the broaching head will be passed through the coke removal opening of the chamber even when the chamber door is only partially opened, and such that the broaching head will be positioned on the floor of the chamber. Movement of the poking bar thereafter will be guided by sliding contact of the broaching head on the floor, and possibly on the side walls, of the chamber.

36 Claims, 12 Drawing Figures

DISCHARGE APPARATUS FOR INCLINED COKE OVENS

BACKGROUND OF THE INVENTION

The invention relates to a device for detaching and/or loosening the coke in a coke oven chamber, in particular the coke formed in an oven chamber of an oblique-chamber coke oven, in order to make possible and/or to assist the free flow of the coke, particularly the formed coke, from the oven chamber, or for scraping off coke which is baked onto and adhered to the floor of the chamber.

Oblique-chamber coke ovens are associated with the problem of obtaining the free flow of the formed coke from the oven chamber subsequent to the coking operation. Free outflow of the coke is frequently hindered by caking of the formed coke and/or jamming of the formed coke in the oven chamber. For reasons of economy of space, the floor of the chamber cannot be made as inclined as might be desirable, and therefore it is also not possible to reliably obtain in this manner free outflow of the formed coke from the oven chamber through an emptying opening provided in the front wall of the oven.

Until the present time, the above problem was solved in a very unsatisfactory manner by having workers standing in front of the oven stoke the mass of formed coke situated within the oven chamber with poking bars, in order to loosen up agglomerations present therein and to start or assist the free outflow of the formed coke. Due to the very high temperatures prevailing and the more or less sudden outflow of the coke, the workers were subjected to extraordinary stresses and even risks while performing this operation, since it was necessary for the workers to stand directly in front of the emptying opening of the coke chamber.

A solution of the above problem effected by means of a machine-type device without a direct stoking operation by workers is associated with the difficulty that especially in the case of an oblique-chamber coke oven, the outflow of the formed coke is controlled by the door of the chamber which is hinged onto the emptying opening and which is pivotable upwardly and outwardly away from the chamber. Thus, during the emptying operation the chamber door is opened only in part, and occasionally only by a gap. Further, the quencher car and the locomotive associated therewith have a relatively high profile and are positioned beneath the emptying opening during the emptying operation, and therefore hinder direct access through the narrow opening gap of the chamber door.

SUMMARY OF THE INVENTION

With the above discussion in mind, it is an object of the present invention to provide a device which makes it possible to bring about the detaching and/or the loosening up of coke in an oven chamber, particularly the coke formed in the oven chamber of an oblique-chamber coke oven, in spite of the above mentioned inaccessibility of the oven chamber, and without the direct employment of personnel in the area in front of the emptying opening.

This object is achieved in accordance with the invention in that a poking bar is guided on a track support, as a function of the shape of the poking bar and/or the track support and of the relative displacement of the poking bar on the track support, so that advancing movement of the poking bar toward and into the chamber is along a predetermined, possibly curved path of displacement. Thereby, the poking bar bypasses obstructing profiles, in particular the profile of the quencher car, and moves into the emptying opening of the coke oven chamber, even when the chamber door is only partially opened until a frontal broaching or stoking head of the poking bar contacts the chamber floor. Such head slides along the floor during further displacement of the poking bar, and such sliding takes over the guiding of the poking bar. During its return movement, the poking bar is displaced along a corresponding path, but inverse order, of displacement.

The present invention is based on the knowledge that, in the case of a more or less caked mass of formed coke situated on the chamber floor, it is sufficient to strike such a mass at the position of the base of the coke mass, with the result that a more or less wide, obliquely upwardly extending cup or portion of the coke mass then begins to slide downwardly, and will thereafter glide in a desired extent and at a desired speed downwardly over the oblique chamber floor and flow out of the emptying opening. Such relatively slight striking at the base of the mass of formed coke is achieved by guiding the poking bar such that its broaching head glides on the chamber floor to the base of the coke mass and strikes the base. However, the guiding of the poking bar to the point where the broaching head of the poking bar contacts the chamber floor is accomplished by the track support and a guide mechanism provided between the poking bar and the track support. In accordance with the above disscussion, during such movement the poking bar must pass through a relatively complex curved displacement path, since in order to reach the position of the base of the mass of formed coke on the chamber floor, the poking bar can enter the oven chamber only through a relatively narrow opening gap of the chamber door, and additionally the direct path to such narrow opening is blocked by the relatively high quencher car structure.

Accordingly, the device of the invention operates in the following manner.

The poking bar is initially positioned in a retracted position on the track support. During advancing movement, the poking bar is guided along the track suupport in the above mentioned, predetermined, possibly curved displacement path around the profile of the quencher car and through the narrow opening gap of the chamber door into the oven chamber. The frontal broaching head of the poking bar then contacts the chamber floor. The guiding of the poking bar on the track support can end at such an instant, and further guiding of the poking bar will be achieved by gliding contact of the frontal broaching head of the poking bar sliding along the chamber floor, until the broaching head reaches the position of the base of the mass of formed coke in the oven chamber and strikes it slightly and/or loosens it up, so as to initiate the emptying operation. The formed coke runs outwardly beneath the broaching head and past the poking bar out of the oven chamber. However, the poking bar can also be rapidly pulled back or retracted at such an instant, so that it will not in any way hinder the free outflow of the formed coke through the emptying opening.

As mentioned above, the outflow of formed coke frequently takes place in a manner such that only an obliquely shaped dislodged portion flows out. As soon as a particular such portion flows out, the poking or loosening procedure starts again, i.e. the poking bar is again guided in the manner described above, with the broaching head moved to the new position of the base of the formed coke mass remaining in the oven chamber, which new base position is situated somewhat further backward and higher than the previous base position.

The guiding of the poking bar on the track support can be accomplished simply by providing the poking bar as a rigid member which is guided along the track support by engagement of a guide template on the poking bar with a guide roller on the track support. The configuration of the template determines the path of displacement of the poking bar.

Such arrangement where the guide template is formed on the poking bar and the guide roller is rotatably mounted on the track support is preferable. However, for the purpose of shortening the total length of the poking bar, the guide template can be provided on the track support and the guide roller can be rotatably mounted on the poking bar.

The guide template may be in the form of a separate element which can be detachably mounted on the poking bar or on the track support. Thereby, a particular guide template can be replaced by one of a different configuration, to thus provide a different poking arm displacement path, for example to accommodate different heights of quencher car profile and/or different positions of the chamber door in the oven wall.

The track support preferably extends in a direction in accordance with the slope of the chamber floor. Also, the inclination of the track support may be variable. Further, the forward end of the track support may be slightly curved upwardly. The general overall direction of guiding of the poking bar is accordingly determined, and any necessary adaptation to the particular predetermined, possibly curved, displacement path of the poking bar need merely be achieved by the special configuration of the template discussed above.

In consideration of the above described spatial conditions, the poking bar may be bent somewhat downwardly in the central portion thereof, and in its initial position on the track support, it may extend with its front portion directed obliquely at an angle somewhat less than the slope of the chamber floor, while having the guide template mounted on its rear portion.

The front end of the poking bar may be bent downwardly at a certain angle so that its entire length does not glide in contact with the chamber floor.

The guiding on the track support and the forward as well as the rearward displacement of the poking bar are easily achieved in that the poking bar is hinged to a trolley which has wheels which run along and are guided by the track support. The poking bar is thus guided along the track support while being pivoted about a horizontal axis on the track support, so that the poking bar is able to pass in a simple manner through the predetermined, possibly curved path of displacement.

A reliable lateral guiding of the poking bar on the track support is achieved in that the trolley wheels have flanges which are guided by horizontal flanges of the track support, the track support flanges being joined by a vertical web, thus forming a double-T shaped configuration.

When the rear portion of the poking bar is hingedly connected to the trolley, it may be additionally laterally guided through brackets positioned at the front portion and possibly also at the central portion of the poking bar, so that it is possible to effect a reliable lateral alignment of the longitudinal direction in which the poking bar is displaced into the oven chamber.

At the front end of the track support, the poking bar can rest on a bar or crosspiece which may be vertically displaceably supported by means of a counterweight.

The forward and backward movement of the poking bar can be effected simply by means of a reversible cable drive. However, conventional hydraulic drives, chain drives or the like may also be used when convenient or expedient. A cable drive has been found to be particularly useful in practice, since it works rapidly and reliably.

In order to avoid a slippage during operation of the cable drive, the cable of the cable drive may be passed over a stretching or tensioning device. Further, the cable may be attached to the trolley by means of spring elements which operate to achieve compensating and stretching functions. In order to avoid slippage or friction of the cable on the track support, the track support mount or the poking bar, the cable can be guided by means of guiding pulleys positioned at the front and rear ends of the track support.

The poking bar as such is preferably formed of heat resistant steel. Further, the poking bar preferably is cooled, e.g. by liquid or gaseous cooling agents. The poking bar may be internally subdivided into separate longitudinal sections or channels for the purpose of cooling. For example, a cooling medium may be led to the broaching head of the poking bar along outer longitudinal sections and returned from the head along a central longitudinal section. The outer jacket and the head of the poking bar are thus cooled most effectively. If the poking bar breaks, the flow of the cooling medium may be switched off through pressure or through-flow sensors and by means of a quick shutoff device attached to the fluid circuit in a conventional manner.

The broaching head may be a separate and detachable component of the poking bar, so that when an old broaching head is worn out it can be simply replaced by another one, e.g. a new broaching head of the same shape. Additionally, the possibility of replacing the broaching head is of importance due to the fact that the device of the invention can be used not only for detaching and/or loosening coke formed in the oven chamber of an oblique-chamber coke oven, but also as a scraping device for removing coke from horizontal-chamber coke ovens. Broaching heads of different shape can then be replaced so that the device can be used for different operations.

For use in detaching and/or loosening up coke formed in the oven chamber of an oblique-chamber coke oven, the broaching head preferably is a blade shovel-shaped or scoop-shaped slide block having a width approximately equal to the width of the inside of the coke oven chamber. Therefore, the broaching head may have surfaces parallel to the chamber floor and the chamber walls and can slide along such chamber floor and chamber walls and detach material adhering thereto. A broaching head of this configuration will also achieve lateral guiding of the poking bar during movement thereof within the oven chamber.

However, for detaching and/or loosening up formed coke, it may be sufficient and/or of advantage if the broaching head consists of a roller or a point or tip. When the device of the invention is to be used as a scraping machine, the broaching head is in the form of a scraper, e.g. provided with sharp teeth or edges. The poking bar may possess lateral runners or skids which operate to achieve the lateral guiding of the poking bar in the oven chamber when sliding contact of the poking bar on the oven wall is substantially only lateral. When the poking bar is equipped with obliquely rearwardly extending projections on the outer surfaces thereof, at least in the front portion thereof, when the poking bar is displaced over the chamber floor, any deposits on the chamber floor are removed in a simple manner during the normal stoking operation.

According to a further special embodiment of the invention, the trolley is provided with an adjustable stop or abutment against which the poking bar is cantilevered, when the poking bar is guided neither by means of the guide template and the guide roller nor by means of the broaching head sliding on the chamber floor. The device of the invention can thus also be used in situations wherein no obstruction prevents the access to the interior of the chamber and wherein it is not necessary to strike or loosen up the formed coke mass at the base chamber floor. Such stop or abutment is preferably adjusted so that the poking bar when positioned in abutment with such a stop can be introduced into the emptying opening without colliding with the chamber door.

Under special conditions, it may be expedient to equip the poking bar with compensating weights to balance out the weight relationships around the point of hinged connection and support of the poking bar during displacement thereof.

In order to protect the device of the invention, a heat protection plate may be arranged beneath the poking bar, preferably in the area of the suspension and the fittings for the feed of a cooling agent. This is desirable since the poking bar and the track support are positioned directly above the quencher car where high temperatures prevail.

In practice it has been found to be particularly effective to equip the device of the invention with a pulsating displacement drive for the poking bar. The mass of formed coke thus can be intermittently loosened and detached from the chamber floor.

The device of the invention is preferably arranged on a supporting frame that can be transported both parallel to and perpendicularly of the coke oven, so that the device of the invention can be employed on all the oven chambers of a coke oven block, and, depending on local conditions and dimensions, can be moved more or less tightly against the front wall of a particular coke oven.

The device of the invention operates very rapidly, and speed is maximized when the contact point of the broaching head on the chamber floor can be placed as close as possible to the position of the base of the mass of formed coke, when the poking bar is advanced into the chamber. The track support is thus arranged to be displaceable in the vertical direction along with the poking bar on the supporting frame. Alternatively, the supporting frame may be arranged to be displaceable in the vertical direction along with the track support and the poking bar. Since, during progressive emptying of an oven chamber, the position of the base of the mass of formed coke situated on the chamber floor is gradually displaced backwardly and upwardly, thereby tending to increase the length of the gliding path of the broaching head on the chamber floor, from the position of initial contact with the chamber floor to the position of the base of the mass of formed coke, such increase can be compensated for by vertical adjustment of the track support or of the supporting frame.

A considerable advantage is also obtained when the track support and the poking bar can be jointly reciprocated in a horizontal direction toward and away from the oven chamber on the supporting frame, or when the supporting frame, the track support and the poking bar can be jointly reciprocated in such direction. Specifically, such reciprocating movements allow, during the horizontal return movements of the poking bar, the broaching head of the poking bar to be separated more quickly from the chamber floor. Therefore, the outlet path for the detached coke can be more immediately cleared, and the broaching head can again be brought onto the chamber floor more rapidly, since it is no longer necessary to pull the poking bar completely out of the oven chamber after each stoking or striking operation.

The device of the invention can be arranged with advantage on a supporting frame which is transportable in front of the coke oven and which also carries a conventional door lifting device as well as the devices for cleaning the door and the frame, since such additional devices are normally employed upon emptying the chambers of a coke oven block.

BRIEF DESCRIPTION OF THE DRAWINGS

Further objects, features and advantages of the present invention will be apparent from the following detailed description of one exemplified embodiment thereof, with reference to the accompanying schematic drawings, wherein.

DETAILED DESCRIPTION OF THE INVENTION

Figure 1:
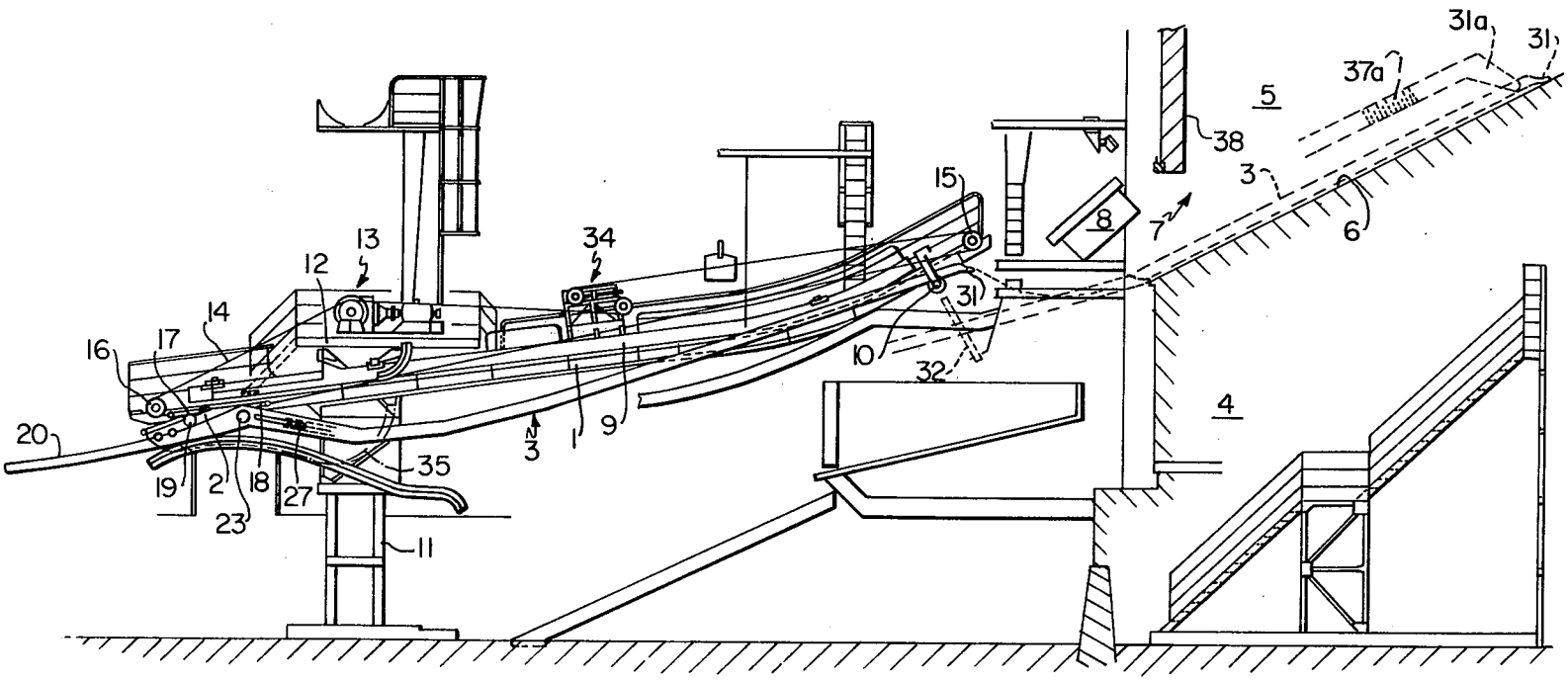
FIG. 1 is a lateral elevation of the device of the invention.
Figure 2:
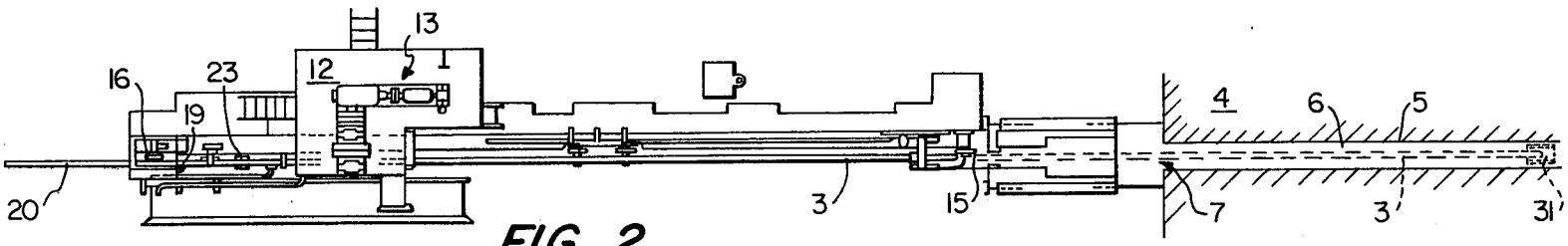
FIG. 2 is a plan view of the device of FIG. 1.

As shown in FIGS. 1 and 2, the stoking machine of the present invention is set up in front of an oblique-chamber coke oven 4 including an oven chamber 5 having an obliquely extending chamber floor 6, an emptying opening 7 formed in a front wall 38, and an upwardly and outwardly pivotable chamber door 8 hinged to front wall 38.

Figure 3D:
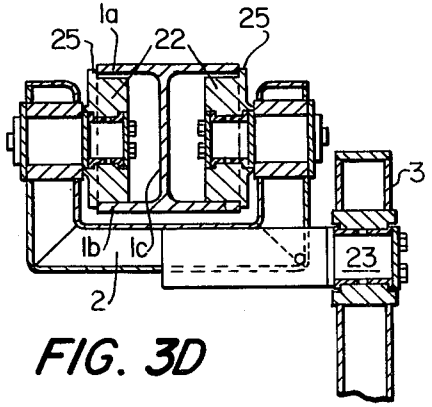
FIG. 3*d* is a section taken along line IIID—IIID of FIG. 3*b;*
Figure 3C:
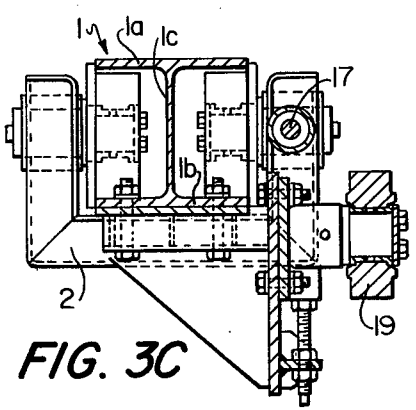
FIG. 3*c* is a section taken along line IIIC—IIIC of FIG. 3*b;*
Figure 4A:
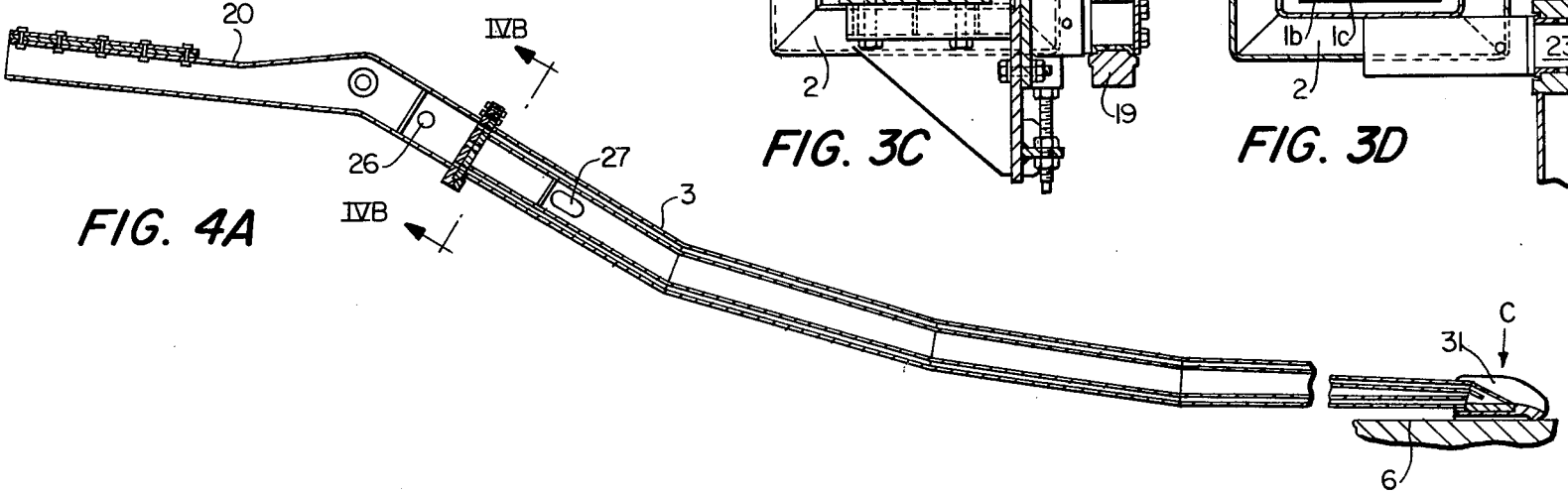
FIG. 4*a* is a longitudinal section of the poking bar of the invention.
Figure 3B:
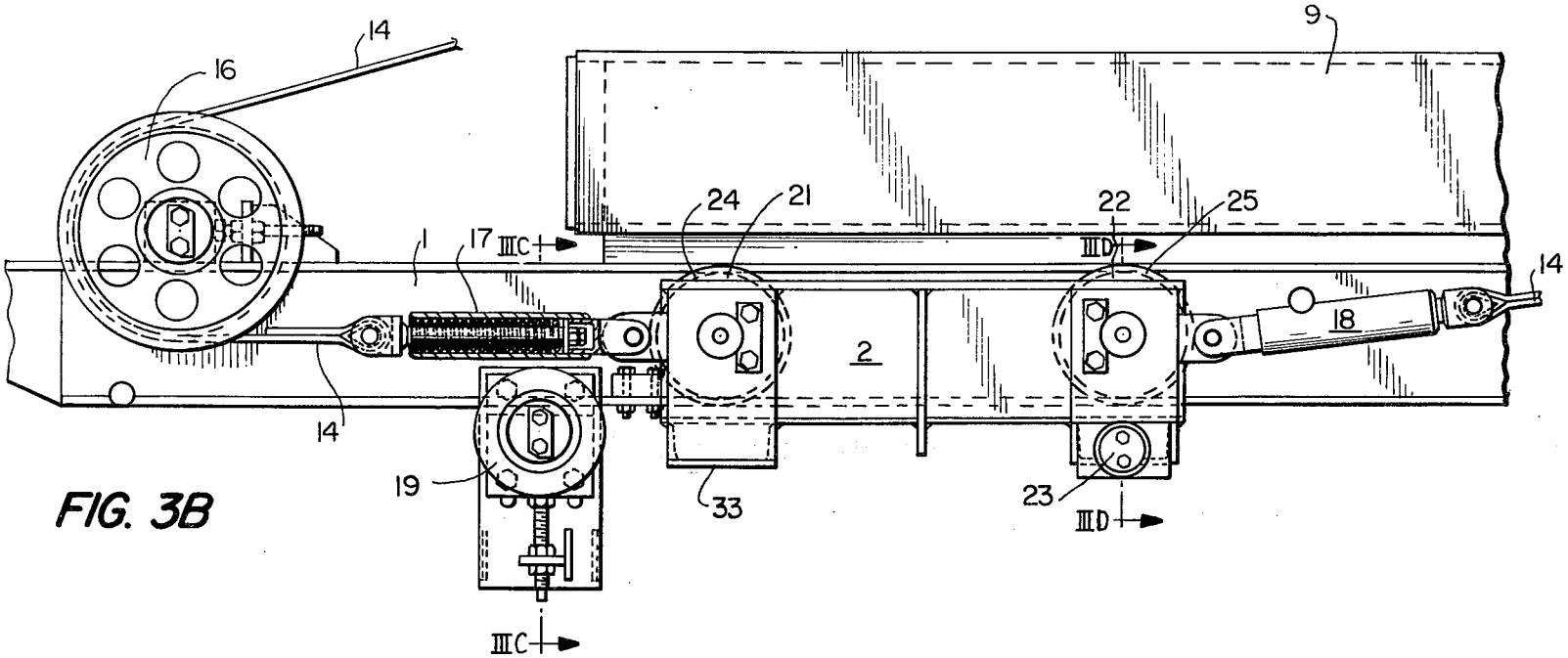
FIG. 3*b* is a lateral elevation view of the trolley of FIG. 3*a;*
Figure 3A:
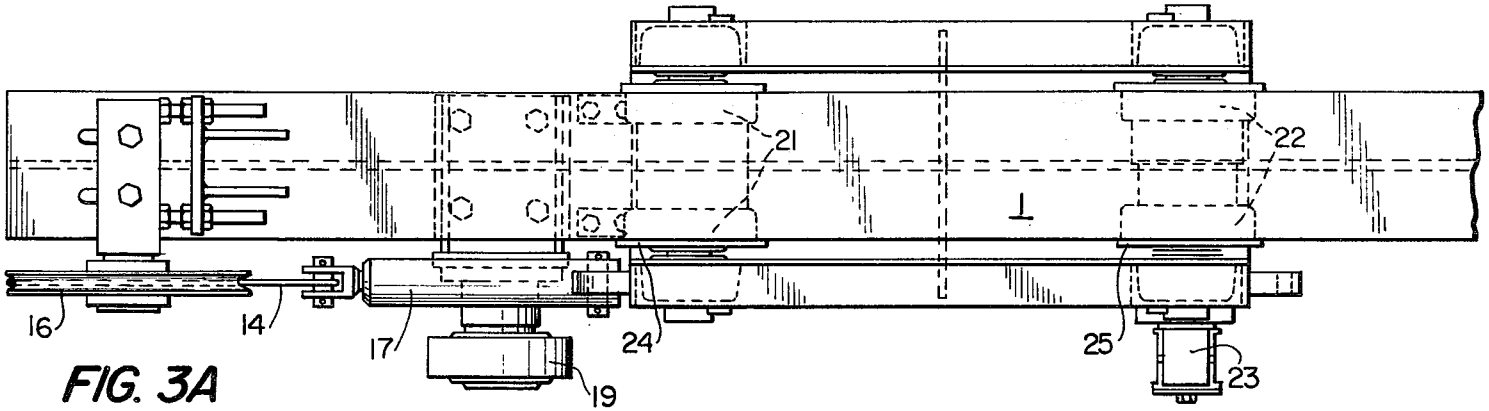
FIG. 3*a* is a plan view of a trolley used with the device of the invention.
Figure 4B:
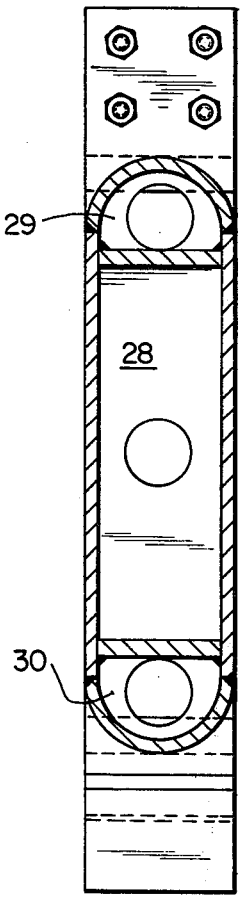
FIG. 4*b* is a enlarged cross-section of the poking bar taken along line IVB—IVB of FIG. 4*a;*
Figure 4C:
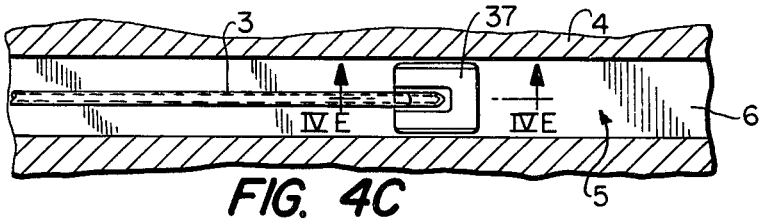
FIG. 4*c* is a plan view of the front end of the poking bar as viewed from the direction of arrow C of FIG. 4*a;*
Figure 4F:
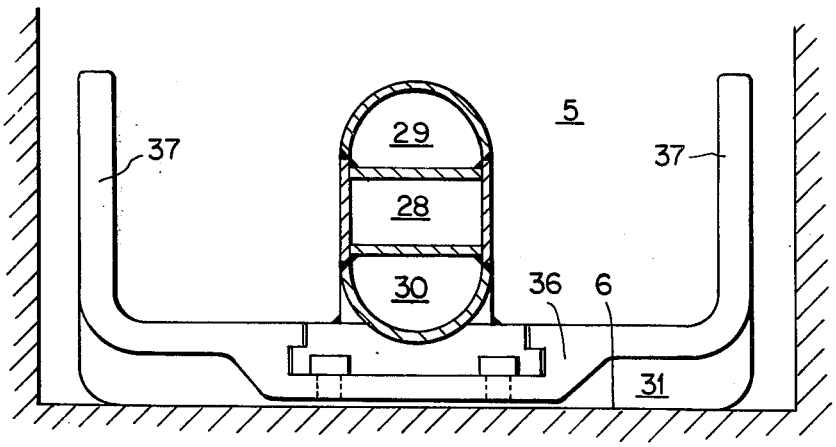
* and FIG. 4*f* is a section taken along line IVF—IVF of FIG. 4*e.*
Figure 4D:
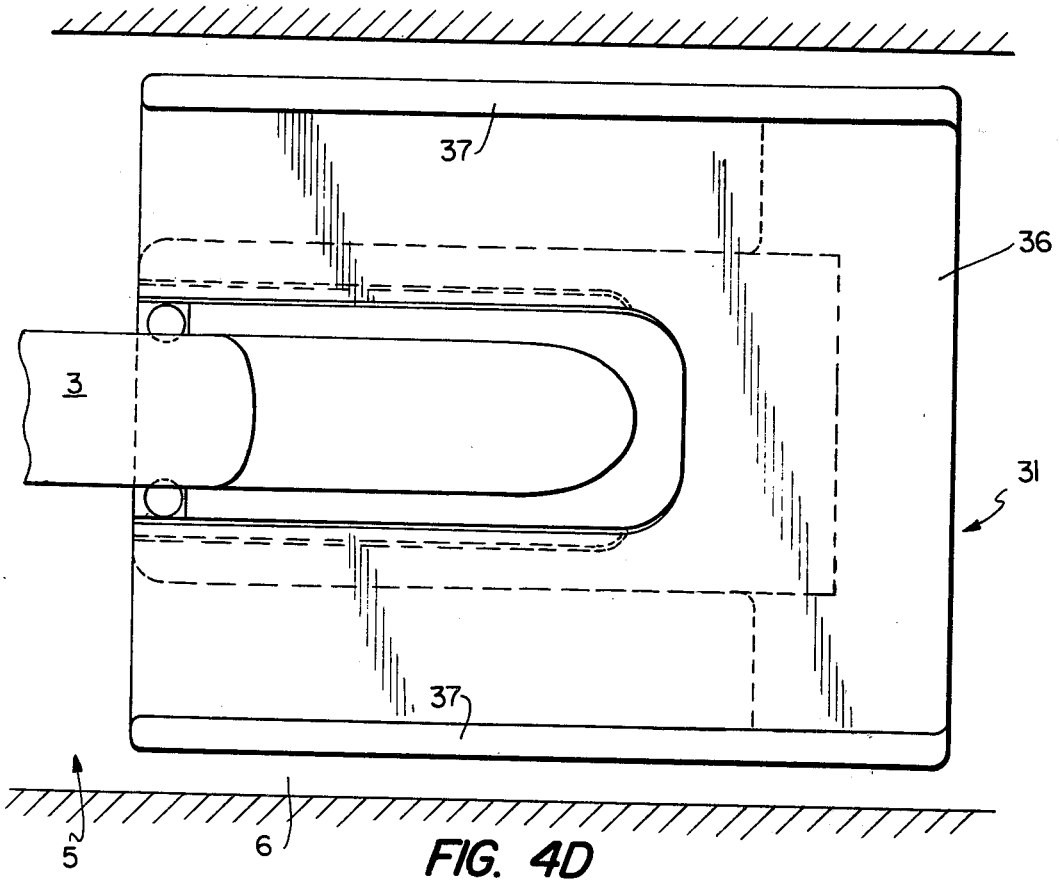
FIG. 4*d* is an enlarged detailed view of the head shown in FIG. 4*c;*
Figure 4E:
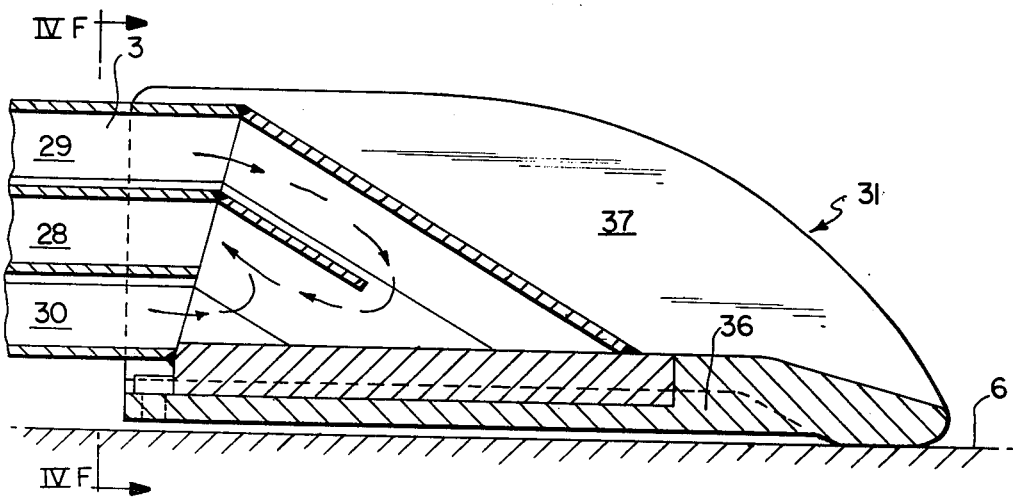
FIG. 4*e* is an enlarged section of the head taken along line IVE—IVE of FIG. 4*c.

A track support 1 is mounted on a support frame 11 to extend in an oblique direction, and has a frontal or forward portion which is bent slightly upwardly. Track support 1 is provided with a reinforcing member such as pipe 9. On track support 1, which has a configuration of an H-shape rotated 90° or of a double-T shape, as shown in FIG. 3c, and including vertically spaced horizontal flanges 1a and 1b joined by a vertical web 1c, there runs a trolley 2 with wheels 21 and 22 which run between and engage the horizontal flanges of track support 1. A poking bar 3 is hingedly connected adjacent the rear portion thereof to trolley 2 by means of pivot 23. Poking bar 3 is bent downwardly in the central portion thereof and, in the initial or rest position shown in the drawings by solid lines, the front portion of poking bar 3 extends obliquely upwardly in a direction approximately corresponding to the inclination of chamber floor 6. Poking bar 3 preferably is made of heat resistant steel, is of rigid structure and carries on the front end thereof a replaceable reaming or broaching tip or head 31.

On the rear end of poking bar 3, i.e. rearwardly of pivot 23, there is formed a guide template 20 which acts as a cam surface and engages a guide roller 19 rotatably mounted on track support 1. Guide template 20 has a structure such that poking bar 3, while it is advanced along track support 1 by means of trolley 2, is caused to move in a curved path, specifically a path over the profile of a quencher car adapted to be positioned in front of emptying opening 7, and then through the gap of only partly opened chamber door 8 and into oven chamber 5, until broaching head 31 is positioned on chamber floor 6. Poking bar 3 has then been advanced by a distance such that guide template 20 is disengaged from guide roller 19, and thereafter further guiding of poking bar 3 during the advancement thereof is achieved by means of broaching head 31 sliding on chamber floor 6. During this further advancement, poking bar 3 moves obliquely upwardly along chamber floor 6 to the position of the base of the mass of formed coke situated in oven chamber 5, and strikes against and loosens such mass of coke. This causes a cup or portion of the coke mass to be detached and, guided by chamber floor 6, such detached portion flows downwardly through emptying opening 7 at a desired speed. Immediately after striking the mass of formed coke, poking bar 3 is retracted, so that the free outflow of the formed coke through emptying opening 7 is not obstructed.

FIG. 1 shows various intermediate positions of poking bar 3 by means of dashed lines, and also shows an alternative configuration of the front portion of poking bar 3, i.e. wherein such front portion is bent downwardly as at 31a and is provided with lateral guide runners or scrapers 37a, e.g. for use in a horizontal-chamber coke oven or for scraping the surfaces of a chamber.

The advance and return movement of poking bar 3 is effected through a cable drive including a cable winch 13 mounted on a bracket 12 carried by support frame 11, a cable 14 which is guided over front end and rear end guide pulleys or rollers 15 and 16, respectively, and which is attached to the front and rear ends of trolley 2 by means of spring elements 18 and 17, respectively. Cable 14 is also led over a stretching device 34. During its advance and return movement, poking bar 3 is laterally guided by and on at least one guide rod 32 which is attached to the front end portion of track support 1. Poking bar 3 thus retains the correct lateral alignment with respect to oven chamber 5. At the front end portion of track support 1, poking bar 3 can also rest on a crosspiece 10 which is mounted to be vertically displaceable by means of a counterweight to thereby balance varying weight relationships about pivot 23 during movement of the poking bar. Crosspiece 10 may be in the form of a roller. A cooling medium may be supplied into the interior of poking bar 3 through a cooling-medium supply hose 35.

FIGS. 3a–3d show details of trolley 2. According to these figures, trolley 2 includes rear wheels 21 and front wheels 22, equipped with flanges 24 and 25, respectively. Trolley 2 is guided by means of these flanges and wheels against and between the horizontal flanges of track support 1, which is in the configuration shown in FIGS. 3c and 3d. FIGS. 3a–3d also illustrate the details of the shape and arrangement of rear guide pulley 16 of cable 14, spring elements 17 and 18 that are hinged on trolley 2, guide roller 19 for guide template 20, guide roller 19 being mounted in a vertically adjustable manner on track support 1, and the mounting of pivot 23 on trolley 2 below front wheels 22. Beneath rear wheels 21, trolley 2 has a vertically adjustable stop 33 for contact with poking bar 3, if the latter is guided neither by engagement between guide roller 19 and guide template 20 nor by engagement of broaching head 31 on chamber floor 6. Poking bar 3 is then held in a cantilevered manner against stop 33.

FIGS. 4a–4f illustrate details of the inner arrangement and arrangement of poking bar 3 as well as the special structure of broaching head 31. As shown in these figures, poking bar 3 is divided into three longitudinal sections, namely a central longitudinal section 28 and two external or outer longitudinal sections 29 and 30 above and below central section 28. Both outer longitudinal sections 29 and 30 feed cooling medium to broaching head 31, and central longitudinal section 28 leads the cooling medium back from broaching head 31. The manner of reversing the fluid flow at the front end is shown especially in FIG. 4e, from which it will be apparent that the major portion of broaching head 31 is directly cooled. The cooling medium is fed through an inlet opening 26 by means of cooling-medium hose 35 (see FIG. 1), and it flows freely outwardly through an outlet opening 27. Broaching head 31 is preferably constructed in the form of a shovel or scoop including a bottom portion 36 which glides on chamber floor 6 and with side walls 37 which extend upwardly from bottom 36 and which extend along the opposite side walls of oven chamber 5. Shovel-shaped head 31 thus is configured to achieve both the vertical and also the horizontal guiding of poking bar 3.

Supporting frame 11 may be designed to be transported in a direction parallel with the front side of a block of coke oven chambers, to be displaced horizontally in a direction toward or away from oven chamber 5, and to be vertically adjustable.

The invention thus provides a device which makes it possible to obtain a considerable reduction in the time required to empty an oblique-chamber coke oven. Further, in the case of a caked coke charge, the device of the invention makes emptying possible without the need to employ workers in front of the oven. The stoking machine can also be used for other purposes, e.g., as a scraping machine in horizontal chamber ovens.

It will be apparent that various modifications may be made to the above specifically described structural arrangements without departing from the scope of the invention.

What is claimed is:

1. A device for discharging, detaching and/or loosening coke within a coke oven chamber of the type having an inclined floor, opposite side walls, a front wall having a coke removal opening therein, the coke removal opening being at the bottom of a coke oven chamber, and a chamber door pivotably hinged to said front wall and pivotable upwardly and outwardly from a position closing said opening to selected positions uncovering said opening by varying amounts, said device comprising:

a track support adapted to be mounted at a position confronting an opening of a coke oven chamber;

an elongated poking bar supported by said track support such that a first end of said poking bar is adapted to be positioned adjacent a coke oven chamber, said poking bar first end having head means for abutting or scraping coke;

means, mounted on said track support, for moving said poking bar from an initial position outside of a coke oven chamber to an operative position whereat said head means is within a coke oven chamber, and for returning said poking bar to said initial position;

guide means associated with said track support for guiding the path of displacement of said poking bar, during a portion of the movement thereof from said initial position in a direction toward said operative position, to follow a predetermined curved course necessary to avoid obstructions located outside a coke oven chamber, to pass said head means through the removal opening of a coke oven chamber and to position said head means on the floor of a coke oven chamber, and for guiding said poking bar during the return movement thereof to follow said predetermined course; and said head means being arranged and constructed to slide on the floor of a coke oven chamber and thereby guide said poking bar during the remaining portion of movement thereof to and from said operative position thereof.

2. A device as claimed in claim 1, wherein said poking bar comprises a rigid element, and said guide means comprises a guide template attached to said poking bar and a guide roller rotatably mounted on said track support, said guide template engaging said guide roller.

3. A device as claimed in claim 1, wherein said poking bar comprises a rigid element, and said guide means comprises a guide template is attached to said track support and a guide roller rotatably mounted on said poking bar, said guide template engaging said guide roller.

4. A device as claimed in claim 1, wherein said poking bar has a downwardly curved central length portion and a front portion including said head means extending in a direction inclined to the horizontal.

5. A device as claimed in claim 1, wherein said head means comprises a scraper having a downwardly bent front portion.

6. A device as claimed in claim 1, further comprising a cross member supported by a counterweight at a position adjacent an end of said track support adapted to be positioned adjacent a coke oven chamber, said poking bar resting on said cross member.

7. A device as claimed in claim 1, wherein said head means is a separate member detachably mounted on said poking bar.

8. A device as claimed in claim 1, wherein said head means has a point at the leading end thereof.

9. A device as claimed in claim 1, wherein said head means has on the sides thereof rearwardly obliquely extending projections for scraping the inner wall surfaces of a coke oven chamber.

10. A device as claimed in claim 1, further comprising compensating weight means on said poking bar for balancing the position thereof.

11. A device as claimed in claim 1, further comprising heat resistant material attached to and positioned beneath said poking bar.

12. A device as claimed in claim 1, wherein said moving means comprises means for pulsatingly moving said poking bar.

13. A device as claimed in claim 1, wherein said track support extends at an angle inclined to the horizontal and has an upwardly curved first end adapted to be positioned to confront a coke oven chamber.

14. A device as claimed in claim 13, further comprising means for adjusting the inclination of said track support.

15. A device as claimed in claim 1, wherein said moving means comprises a trolley mounted to move along said track support, said poking bar being pivotably attached to said trolley.

16. A device as claimed in claim 15, wherein said track support comprises a pair of vertically spaced horizontal flanges, and said trolley includes wheels riding on and between said spaced flanges, said wheels having peripheral flanges abutting against said spaced flanges.

17. A device as claimed in claim 1, further comprising guide rod means, positioned at an end of said track support adapted to be positioned adjacent a coke oven chamber, for laterally guiding said poking bar.

18. A device as claimed in claim 17, further comprising guide rod means, positioned adjacent the central portion of the length of said track support, for laterally guiding said poking bar.

19. A device as claimed in claim 1, wherein said head means comprises a shovel-shaped member configured to slide on the floor of a coke oven chamber and having a width approximately equal to the width of a coke oven chamber.

20. A device as claimed in claim 19, wherein said shovel-shaped member has a bottom and wall portions extending upwardly from opposite lateral sides of said bottom, said wall portions adapted to slide against the inner walls of a coke oven chamber and guide movement of said shovel-shaped member therein.

21. A device as claimed in claim 1, further comprising movably positioned support frame means for supporting said track support.

22. A device as claimed in claim 21, wherein said track support is vertically adjustably mounted on said support frame means.

23. A device as claimed in claim 21, wherein said support frame means is vertically movable to adjust the vertical positions of said track support and said poking bar.

24. A device as claimed in claim 21, wherein said track support is horizontally reciprocatingly movably mounted on said support frame means.

25. A device as claimed in claim 21, wherein said support frame means is horizontally reciprocatingly movable in a direction longitudinal of said track support to adjust the relative positions of said track support and said poking bar with respect to a coke oven chamber.

26. A device as claimed in claim 21, wherein said support frame means is horizontally movable in a direction transverse of said track support to move said device in a direction parallel to the front wall of a coke oven.

27. A device as claimed in claim 15, wherein said moving means further comprises a reversible cable drive mounted on said track support and including a cable attached to said trolley.

28. A device as claimed in claim 27, further comprising means for tensioning said cable.

29. A device as claimed in claim 27, wherein said cable drive comprises a pulsating drive means for pulsatingly moving said trolley and thus said poking bar along said track support.

30. A device as claimed in claim 15, wherein said guide means comprises an abutment stop on said trolley, said poking bar abutting against said abutment stop in a cantilevered manner.

31. A device as claimed in claim 30, wherein said abutment stop including means for vertically adjusting said abutment stop.

32. A device as claimed in claim 1, wherein said poking bar is formed of a heat resistant material.

33. A device as claimed in claim 32, wherein said poking bar comprises an inner longitudinally extending section and at least one outer longitudinally extending section, said sections joining and being connected at the interior of said head means.

34. A device as claimed in claim 33, further comprising means for introducing a cooling fluid into said outer section, whereby said cooling fluid flows through said outer section and into said interior of said head means and from said head means through said inner section, and means for discharging said fluid from said inner section.

35. A device as claimed in claim 27, further comprising spring means for attaching opposite ends of said cable to respective opposite ends of said trolley.

36. A device as claimed in claim 35, further comprising guide pulleys at opposite ends of said track support, said cable being guided by said guide pulleys.

* * * * *